US011339782B2

(12) United States Patent
Leimbach

(10) Patent No.: US 11,339,782 B2
(45) Date of Patent: May 24, 2022

(54) MULTI-CHAMBER IMPELLER PUMP

(71) Applicant: LeimbachCausey, LLC, Santa Fe, NM (US)

(72) Inventor: Matthew August Leimbach, Madrid, NM (US)

(73) Assignee: LeimbachCausey, LLC, Santa Fe, NM (US)

( * ) Notice: Subject to any disclaimer, the term of this patent is extended or adjusted under 35 U.S.C. 154(b) by 0 days.

(21) Appl. No.: 17/352,010

(22) Filed: Jun. 18, 2021

(65) Prior Publication Data

US 2021/0404465 A1 Dec. 30, 2021

Related U.S. Application Data

(60) Provisional application No. 63/044,930, filed on Jun. 26, 2020.

(51) Int. Cl.

| | |
|---|---|
| ***F04C 5/00*** | (2006.01) |
| ***F04C 2/44*** | (2006.01) |
| ***F04C 15/06*** | (2006.01) |
| ***F01C 21/10*** | (2006.01) |

(52) U.S. Cl.

CPC ..... *F04C 5/00* (2013.01); *F01C 21/106* (2013.01); *F04C 2/44* (2013.01); *F04C 15/06* (2013.01); *F04C 2240/20* (2013.01)

(58) Field of Classification Search

CPC ..... F01C 21/106; F04C 15/06; F04C 2/44; F04C 2240/10; F04C 2240/20; F04C 5/00

See application file for complete search history.

(56) References Cited

U.S. PATENT DOCUMENTS

| | | | |
|---|---|---|---|
| 1,053,321 | A | 2/1913 | Schrock |
| 2,052,474 | A | 8/1936 | Johnson |
| 2,189,356 | A | 2/1940 | Briggs |
| 2,203,974 | A | 6/1940 | Weinhardt |
| 2,258,371 | A | 10/1941 | Wernert |
| 2,455,194 | A | 11/1948 | Rumsey |

(Continued)

FOREIGN PATENT DOCUMENTS

| | | | |
|---|---|---|---|
| DE | 10 2010 062 298 | A1 | 6/2012 |
| DE | 10 2017 107 643 | A1 | 10/2018 |

(Continued)

*Primary Examiner* — Mary Davis

(74) *Attorney, Agent, or Firm* — Santa Fe IP, LLC

(57) ABSTRACT

A multi-chamber impeller pump includes an impeller, circumferentially spaced cams defining an impeller chamber, and circumferentially spaced evacuation ports. Each cam includes an engagement edge, an arcuate cam surface sloping radially inward, and a lobe. Each evacuation port is proximal to an intersection of a respective arcuate cam surface and lobe. As the impeller rotates, a corresponding end of a leading blade contacts a respective engagement edge and then a corresponding end of a trailing blade contacts the respective engagement edge thereby forming a unit chamber between leading and trailing blades. As the impeller continues to rotate, the end of the leading blade contacts a respective lobe and displaces the leading blade to decrease the volume of the unit chamber and expel fluid from the unit chamber through a respective evacuation port. A method of using the multi-chamber impeller pump is also disclosed.

21 Claims, 10 Drawing Sheets

(56) References Cited

U.S. PATENT DOCUMENTS

| | | | | |
|---|---|---|---|---|
| 2,460,952 | A | 2/1949 | Simer et al. | |
| 2,466,440 | A | 4/1949 | Kiekhaefer | |
| 2,499,163 | A | 2/1950 | Rand | |
| 2,599,600 | A | 6/1952 | Arnold | |
| 2,663,263 | A | 12/1953 | Mayus et al. | |
| 2,684,035 | A | 7/1954 | Kemp | |
| 2,772,637 | A | 12/1956 | Doble | |
| 2,789,511 | A | 4/1957 | Doble | |
| 2,843,049 | A | 7/1958 | Sherwood | |
| 2,856,859 | A | 10/1958 | Baade et al. | |
| 2,899,902 | A | 8/1959 | Bandli et al. | |
| 2,902,935 | A | 9/1959 | Dinnison et al. | |
| 2,911,920 | A | 11/1959 | Thompson | |
| 3,001,480 | A | 9/1961 | Pike | |
| 3,054,355 | A | 9/1962 | Neely | |
| 3,161,135 | A | 12/1964 | Eriksson | |
| 3,289,591 | A | 12/1966 | Eriksson | |
| 3,303,791 | A | 2/1967 | Doble | |
| 3,364,867 | A | 1/1968 | Segelhorst et al. | |
| 3,386,386 | A | 6/1968 | Eriksson | |
| 3,832,105 | A | 8/1974 | Takahashi | |
| 4,392,779 | A | 7/1983 | Bloemers et al. | |
| 4,508,492 | A | 4/1985 | Kusakawa et al. | |
| 4,718,837 | A | 1/1988 | Frazzell | |
| 4,940,402 | A | 7/1990 | McCormick | |
| 5,571,005 | A | 11/1996 | Stoll et al. | |
| 5,599,171 | A * | 2/1997 | Horwitz | F04C 5/00 417/199.2 |
| 6,619,938 | B2 | 9/2003 | Woodruff | |
| 2001/0004447 | A1 | 6/2001 | Barnes | |
| 2002/0192100 | A1 | 12/2002 | Wheeler et al. | |
| 2014/0116110 | A1 | 5/2014 | Katase | |
| 2014/0301833 | A1 | 10/2014 | Salmela et al. | |
| 2015/0300174 | A1* | 10/2015 | Schevets | F04C 15/06 418/15 |
| 2017/0130715 | A1* | 5/2017 | Drysdale | F04C 5/00 |
| 2018/0291897 | A1 | 10/2018 | Schneider | |

FOREIGN PATENT DOCUMENTS

| | | |
|---|---|---|
| WO | WO 99/66208 A1 | 12/1999 |
| WO | WO 03/48582 A1 | 6/2003 |

* cited by examiner

MULTI-CHAMBER IMPELLER PUMP

CROSS-REFERENCES TO RELATED APPLICATIONS

This application claims priority to U.S. Provisional Patent Application No. 63/044,930 filed Jun. 26, 2020 and entitled MULTI-CHAMBER IMPELLER PUMP, the entire contents of which is incorporated herein for all purposes by this reference.

BACKGROUND OF INVENTION

Field of Invention

This application relates, in general, to multi-chamber impeller pumps and methods for their use.

Description of Related Art

Positive displacement pumps have been a popular choice in various applications, including solar powered applications, as such pumps are generally smaller and economical. And flexible impeller pumps are a popular type of positive displacement pumps due to their self-priming and generally smooth operation. Exemplars of such impeller pumps are U.S. Pat. No. 2,189,356 to Briggs and U.S. Pat. No. 2,663,263 to Mayus et al. Such flexible impeller pumps, however, have certain design features that limit them from achieving higher flow rates and higher-pressure capabilities.

Flow rates may be limited when a fluid unit must be propelled a significant distance through a pump, while pressure capabilities may be limited when a fluid unit is propelled a minimal distance through a pump. For example, flow rates may be limited by the configuration of the rotary pump disclosed in the '356 patent because each fluid unit must be propelled approximately 270° around the pump housing, thus reducing the efficiency per revolution of the pump. And pressure capabilities may be limited by the configuration of the rotary pump in the '263 patent because the minimal distance between inlets and outlets offers little resistance to backward flexing of impeller vanes, thus reducing the pressure differential between outlets and inlets.

It would therefore be useful to provide a multi-chamber impeller pump that overcomes the above and other disadvantages of known flexible impeller pumps.

BRIEF SUMMARY

One aspect of the present invention is directed to a pump including: an impeller having a hub and a plurality of blades extending radially from the hub, each blade having an end; a plurality of circumferentially spaced cams defining an impeller chamber within which the impeller is rotatably mounted; wherein each cam includes an engagement edge, an arcuate cam surface sloping radially inward from the engagement edge, and a lobe that extends radially inward from the arcuate cam surface; and a plurality of circumferentially spaced evacuation ports, each evacuation port being proximal to the intersection of the arcuate cam surface and the lobe of a respective cam; wherein, as the impeller rotates, a corresponding end of a leading blade contacts a respective engagement edge and then a corresponding end of a trailing blade subsequently contacts the respective engagement edge thereby forming a unit chamber between the leading and trailing blades, the impeller hub, and the respective cam; and wherein, as the impeller continues to rotate, the end of the leading blade contacts a respective lobe and displaces the leading blade to decrease the volume of the unit chamber and expel fluid from the unit chamber through a respective evacuation port.

The pump may further include: a housing having a peripheral wall, wherein the cams are located radially inward from the peripheral wall; a peripheral reservoir defined between the peripheral wall and the cams; and a plurality of suction ports fluidly communicating the peripheral reservoir with the impeller chamber, each suction port being defined by a respective lobe of a first cam and a respective engagement edge of an adjacent second cam; wherein, as the impeller rotates, the impeller draws fluid from the peripheral reservoir through the suction ports and delivers fluid to the evacuation ports.

The plurality of circumferentially spaced cams may include four circumferentially spaced cams.

The pump may include a housing with a planar wall from which the cams are cantilevered and through which the evacuation ports extend, wherein each lobe may be proximate to a respective evacuation port and extend away from the planar wall to a free end, wherein the free end may extend above the respective evacuation port.

A portion of each free end may be perpendicularly above the respective evacuation port.

The portion of each free end may perpendicularly cover the respective evacuation port.

Each lobe may include a loading surface extending radially inward from the arcuate cam surface and a release surface extending radially outward from the loading surface; wherein, as the impeller rotates, the blade ends disengage from the cams as a respective blade end passes from the loading surface to the release surface.

The loading surface may smoothly transition from the arcuate cam surface allowing the blade ends to sweep along the arcuate cam surface and the loading surface past the evacuation port.

Respective loading and release surfaces may angularly intersect to form a release edge, whereby the ends of the impeller blades abruptly disengage from the cams as a respective blade end passes over the release edge.

The pump may further include a housing, the housing having a peripheral wall and a cam wall, the cam wall having an inner planar surface against which the impeller rotates, wherein the cams project from the cam wall.

The cams and the cam wall may be monolithically formed.

The cams, cam wall and peripheral wall may be monolithically formed.

The pump may further include an inlet port monolithically formed in the peripheral wall.

The pump may further include an outlet manifold extending from the cam wall, wherein the outlet manifold may include a plurality of lumina, each corresponding to a respective evacuation port.

The outlet manifold may be monolithically formed with the cam wall.

The outlet manifold may include an outlet port, wherein each lumen has a first internal cross section proximal the respective evacuation port and a second internal cross section proximal the outlet port, and wherein the second cross section is smaller than the first.

Each lumen may have a first internal cross section proximal the respective evacuation port and a second internal cross section proximal an outlet port, wherein the second cross section is larger than the first.

Each lumen may spiral from a respective evacuation port along a gradually tightening curve.

The outlet manifold may include an outlet port, wherein each lumen has a first internal cross section proximal the respective evacuation port and a second internal cross section proximal the outlet port, and wherein the second cross section is smaller than the first.

Each lumen may linearly extend from a respective evacuation port to an outlet port.

Each lumen may extend from a respective evacuation port to a common outlet port.

Each lumen may extend from a respective evacuation port to a corresponding outlet port.

The outlet manifold may include an outlet port having an axis, wherein each lumen is fluidly connected to the outlet port at a respective junction, and wherein one or more of the respective junctions are axially spaced within the outlet port from one another.

Another aspect of the present invention is directed to a pump including: an impeller having a hub and a plurality of blades extending radially from the hub, each blade having an end; a housing including a peripheral wall, a plurality of circumferentially spaced cams located radially inward from the peripheral wall, and a peripheral reservoir defined between the peripheral wall and the cams, wherein the cams define an impeller chamber within which the impeller is rotatably mounted, and wherein each cam includes an engagement edge and a release surface; a plurality of suction ports fluidly communicating the peripheral reservoir with the impeller chamber, each suction port being defined by a respective release surface of a first cam and a respective engagement edge of an adjacent second cam; and a plurality of circumferentially spaced evacuation ports, each evacuation port being intermediate the engagement edge and the release surface of a respective cam; wherein, as the impeller rotates, the impeller draws fluid from the peripheral reservoir through the suction ports and delivers fluid to the evacuation ports.

Each lobe may extend radially inward from each respective arcuate cam surface, and wherein each evacuation port may be proximal the intersection of the arcuate cam surface and the lobe of a respective cam; wherein, as the impeller rotates, a corresponding end of a leading blade contacts a respective engagement edge and a corresponding end of a trailing blade subsequently contacts the respective engagement edge thereby forming a unit chamber between the leading and trailing blades, the impeller hub, and the respective cam; and wherein, as the impeller continues to rotate, the corresponding end of the leading blade contacts a respective lobe and displaces the leading blade to decrease the volume of the unit chamber and expel fluid from the unit chamber through a respective evacuation port.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
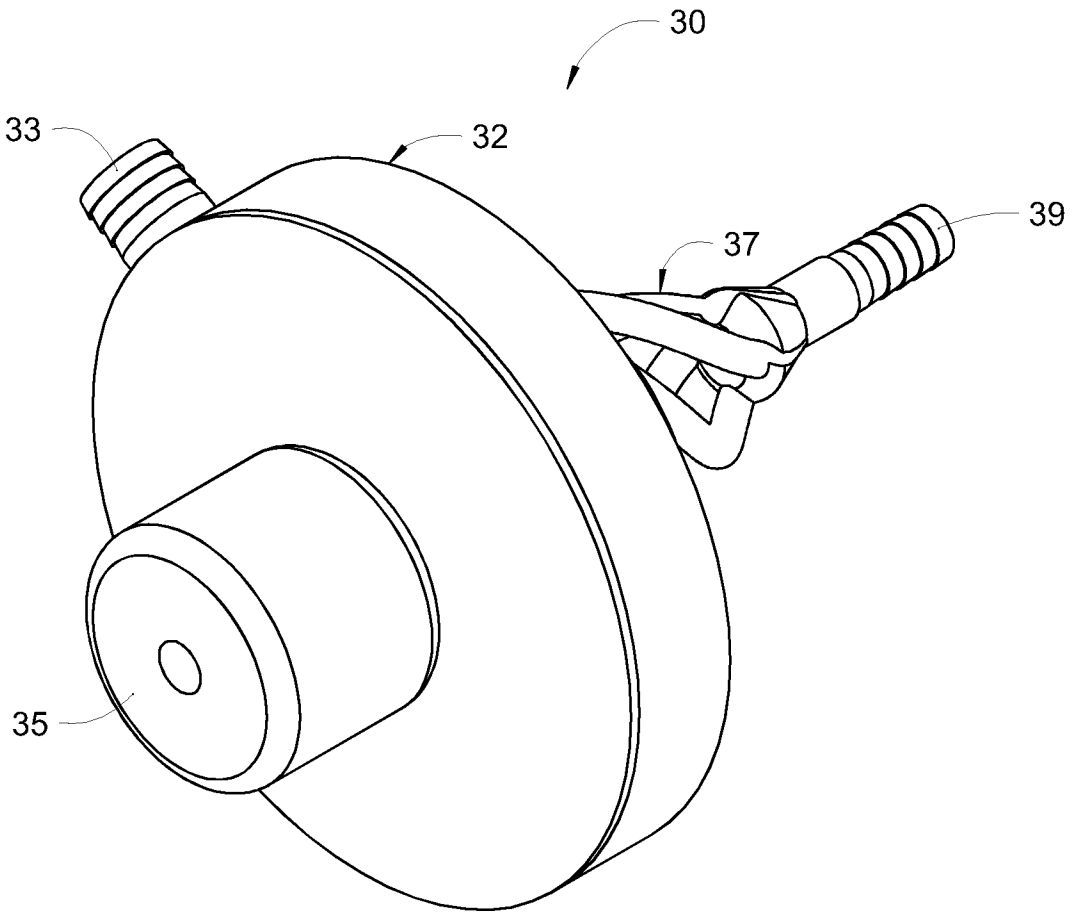
FIG. 1 is a perspective view of an exemplary multi-chamber impeller pump in accordance with various aspects of the present invention.
Figure 2:
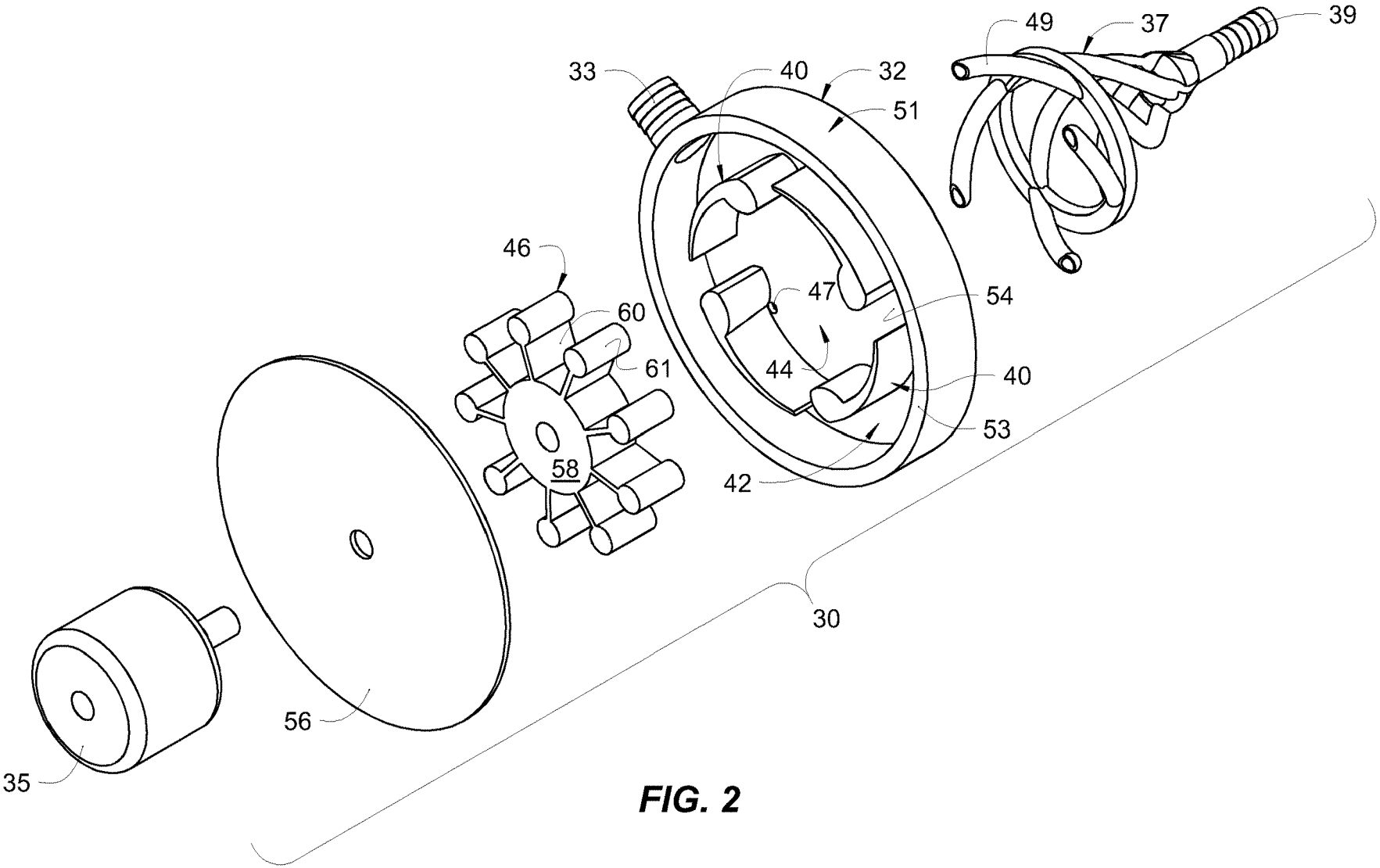
FIG. 2 is an exploded view of the pump shown in FIG. 1.

Turning now to the drawings, wherein like components are designated by like reference numerals throughout the various figures, attention is directed to FIG. 1 which shows a multi-chamber impeller pump 30 generally including a housing 32 having an inlet 33, a motor 35, and an outlet manifold 37 fluidly connecting evacuation ports of the housing to an outlet 39. With reference to FIG. 2, the housing supports a number of circumferentially spaced cams 40 that define a peripheral reservoir 42 and an impeller chamber 44 within which impeller 46 rotates. Each cam includes a corresponding cam outlet or evacuation port 47 that is fluidly connected to a branch 49 of the manifold.

With continued reference to FIG. 2, housing 32 generally includes a body 51 having a peripheral wall 53 and a cam wall 54 that form an interior pump chamber enclosed by a pump cover 56. As can be seen in FIG. 2, motor 35 has a drive shaft that extends through the pump cover to drive the impeller in an otherwise conventional manner.

The impeller 46 generally includes a hub 58 and a plurality of blades 60 extending radially from the hub, and each blade has an end 61. Suitable materials for the impeller include various polymers such as EPDM rubber, neoprene, nitrile rubber, rubber, silicon and/or other suitable materials. One will appreciate that the impeller hub may be formed of a stiffer polymer and/or other materials in order to provide greater structural integrity to the impeller.

As discussed in greater detail below, cam wall 54 has an inner planar surface to which cams 40 are mounted. The cams are spaced from and radially inward from peripheral wall 53 thereby defining impeller chamber 44. Impeller 46 rotates within the impeller chamber between the pump cover 56 and the inner planar surface of the cam wall 54.

With continued reference to FIG. 2, cams 40 are mounted to and extend from cam wall 54 in a cantilevered fashion. And each cam is provided with an evacuation port 47 that extends through the cam wall.

The housing, cover and/or manifold may be formed of various materials including metals, plastics, ceramics, composites, and/or other suitable materials. For example, stainless steel and/or high-density polyethylene (HDPE) may be used for advanced applications, while polyvinyl chloride (PVC) may be used for more economical applications.

In various embodiments the cams and the cam wall may be monolithically formed, the cam wall and peripheral wall may be monolithically formed, and/or the inlet and peripheral wall may be monolithically formed. Such monolithic configurations are particularly well suited for additive manufacturing processes such as 3D printing. One will appreciate that subtractive manufacturing may also be used to machine or mill, molding may be used to shape, and/or other suitable processes may be used to form these structures.

Figure 3:
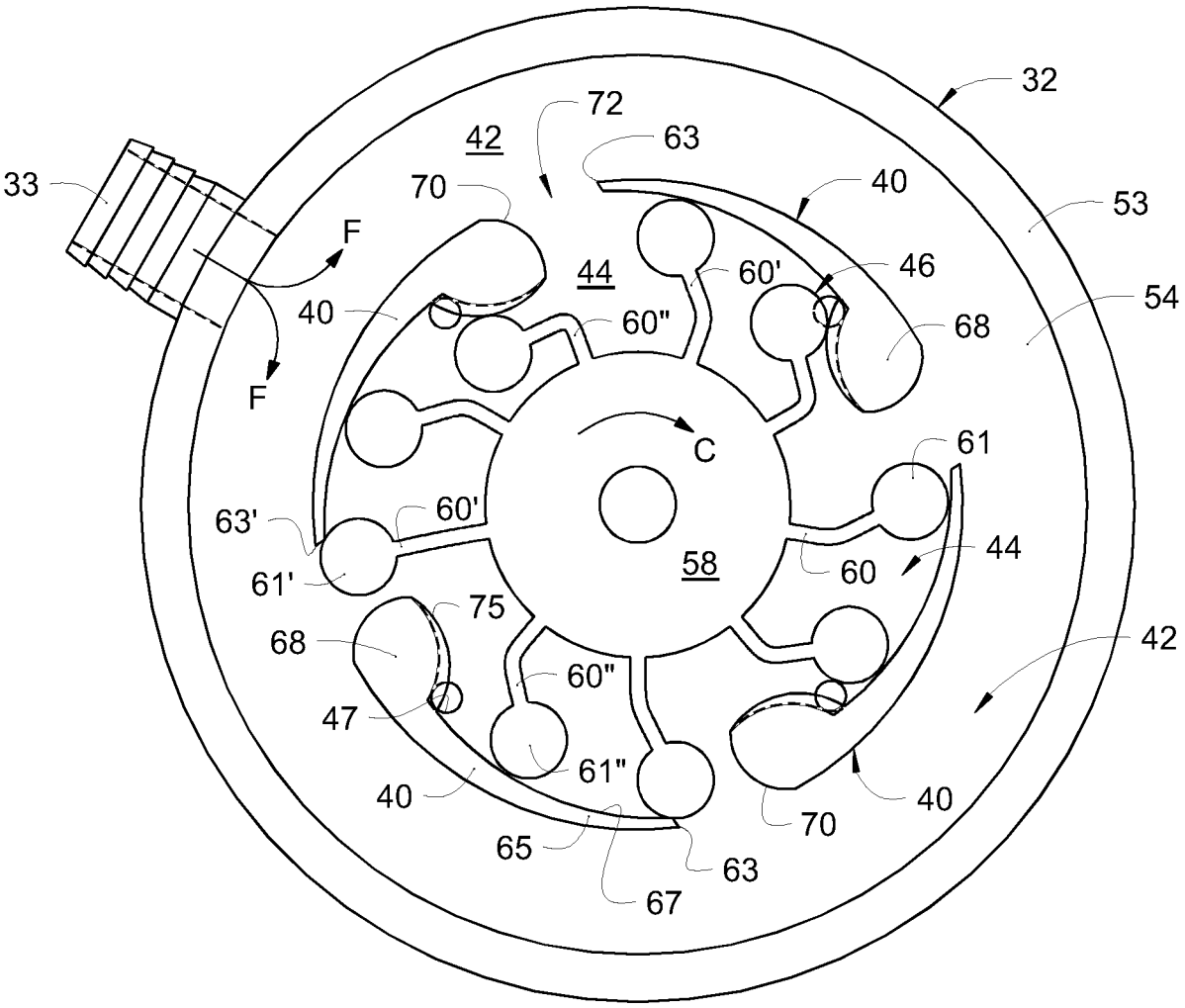
FIG. 3 is a front view of the pump shown in FIG. 1 with a cover and motor removed to show an interior of the pump.

With reference to FIG. 3, a plurality of circumferentially spaced cams 40 are located radially inward from the peripheral wall 53 to functionally divide the interior pump chamber into a peripheral reservoir 42 (radially outside of the cams) and an impeller chamber 44 (radially within the cams) in which the impeller rotates. Each cam 40 includes an engagement edge 63, a cam tail 65 with an arcuate cam surface 67 sloping radially inward from the engagement edge, and a lobe 68 that further extends radially inward from the arcuate cam surface. Among other things, the radially sloping configuration of the arcuate cam surface maintains increasing pressure on the impeller blades as the impeller rotates that, along with pressure against the blades from within trailing unit chambers, may prevent the blades from flexing too far backward and may thus prevent backflow.

With continued reference to FIG. 3, as the impeller rotates clockwise (see arrow C), the ends of the impeller blades contact each cam at a respective engagement edge (see, e.g., blade end 61 and engagement edge 63) and the blades continue to bend (see, e.g., blades 60' in FIG. 4A, FIG. 4B, and FIG. 4C) as the blade travels along a respective cam tail and respective lobe. As the blades pass the lobe, the ends of the blades disengage from the cam as the blade ends pass a release surface 70 located on the lobe opposite from the engagement edge and cam tail.

The circumferentially spaced configuration of the cams form a plurality of suction ports 72 fluidly communicating peripheral reservoir 42 with the impeller chamber 44. Each suction port is defined by a respective release surface 70 of a first cam and a respective engagement edge 63 of an adjacent second cam. As impeller 46 rotates in the direction of arrow C, the impeller draws fluid from peripheral reservoir 42 through suction ports 72 into impeller chamber 44, and between adjacent impeller blades (e.g., blades 60' and 60") as shown in FIG. 4A. As the impeller blades have an inherent shape memory, when a blade end releases from a cam and passes across a suction port, the blade may flick or snap forward to its straight position in a single action that may also serve to pull fluid from the peripheral reservoir, through the suction port, and into the impeller chamber between the blades.

As the impeller continues to rotate, the fluid between the adjacent impeller blades is moved within unit chamber 74 past the engagement edge (see, e.g., FIG. 4A), along the cam (see, e.g., FIG. 4B), and delivered to the respective evacuation port (see, e.g., FIG. 4C), as discussed in greater detail below.

Figure 4C:
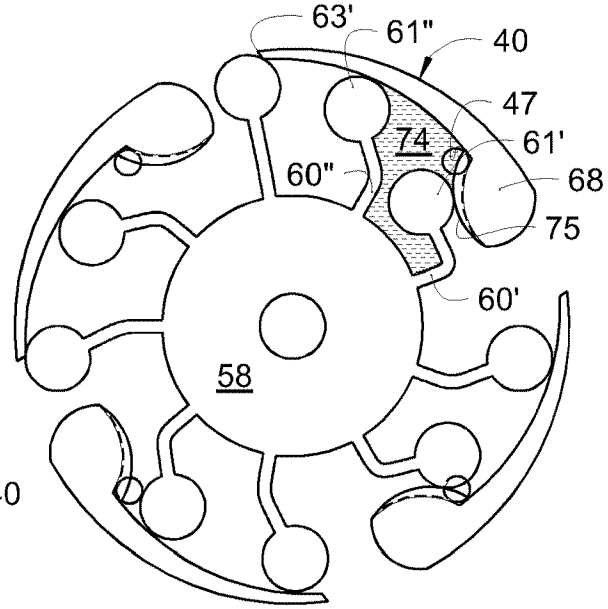
FIG. 4A, FIG. 4B and FIG. 4C are schematic views of the cams and impeller of the pump shown in FIG. 1, the sequence of figures showing a unit of fluid propelled as the impeller rotates.
Figure 4B:
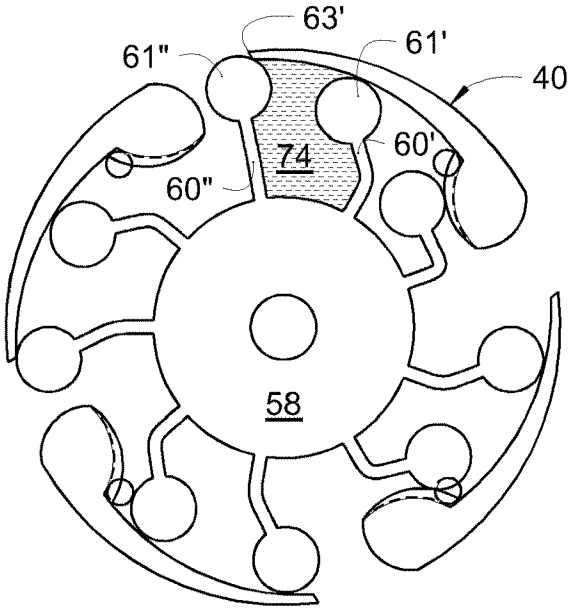
Figure 4A:
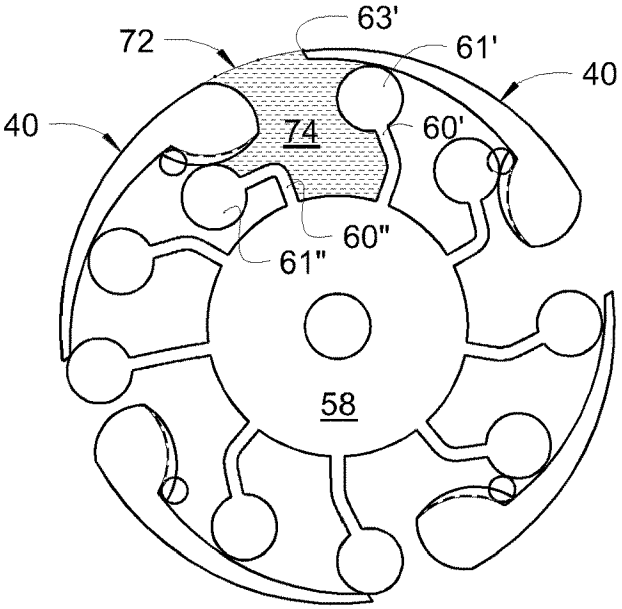

With reference to FIG. 3, FIG. 4B and FIG. 4C, an evacuation port 47 is provided for each cam 40 and is located proximal to the intersection of cam tail 65 and lobe 68 of a respective cam. As impeller 46 rotates, a corresponding end 61' of a leading blade 60' contacts a respective engagement edge 63' and then a corresponding end 61" of a trailing blade 60" subsequently contacts the respective engagement edge 63' thereby forming a blade chamber or unit chamber 74 between (i) the leading and trailing blades 60' and 60", (ii) impeller hub 58, and (iii) the respective cam 40, as shown in FIG. 4B. As the impeller continues to rotate, the unit of fluid within unit chamber 74 advances along the respective cam until end 61' of the leading blade 60' contacts a loading surface 75 of a respective lobe 68 and further displaces (e.g., flexes) the leading blade 60' backward to decrease the volume of unit chamber 74 and expel fluid from the unit chamber through a respective evacuation port 47, as shown in FIG. 4C.

In various embodiments, the loading surface 75 may smoothly transition from the arcuate cam surface 67 allowing the blade ends 61 to smoothly sweep along the arcuate cam surface and the loading surface past the evacuation port 47. For example, a fillet may interconnect the arcuate cam surfaces 67 and the corresponding loading surfaces 75.

Figure 6:
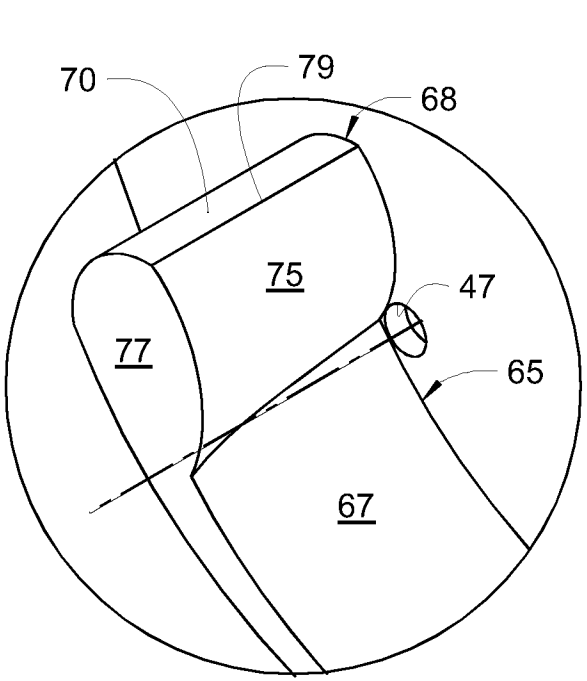
FIG. 6 is an enlarged perspective view of a cam and an adjacent evacuation port shown in FIG. 5.
Figure 5:
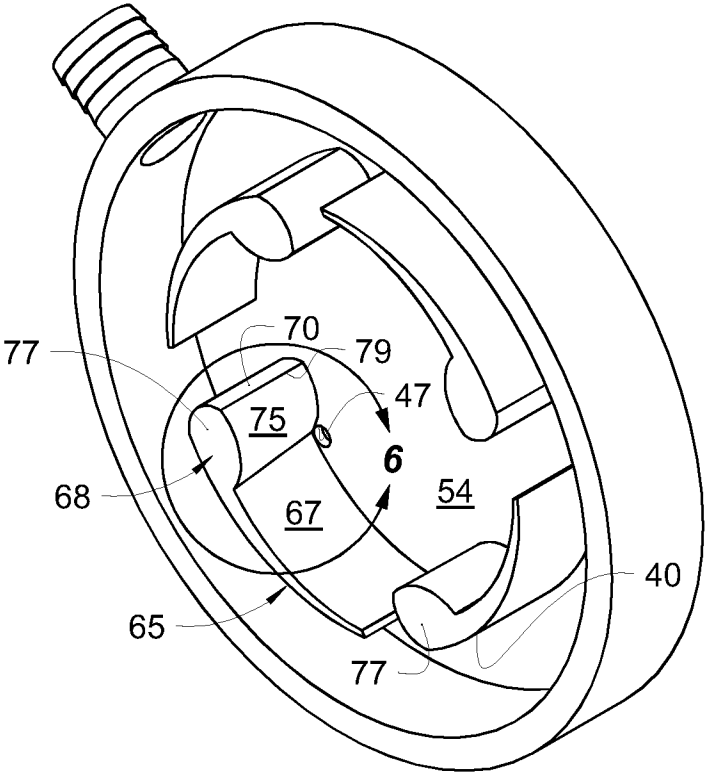
FIG. 5 is a perspective view of a pump housing with circumferentially spaced cams defining an impeller chamber of the pump shown in FIG. 1.

With reference to FIG. 5, each cam 40 is mounted in a cantilevered fashion to cam wall 54, and each lobe 68 terminates in a free end 77. In order to facilitate the blades in sweeping or otherwise directing fluid toward the evacuation port, loading surface 75 may be inclined toward the evacuation port, as shown in FIG. 6. In particular, free end 77 may extend above the respective evacuation port 47 such that the free end perpendicularly covers the respective evacuation port. One will appreciate that the free end may perpendicularly cover or extend across the respective evacuation port either partially or wholly in order to sufficiently incline loading surface toward the evacuation port.

In various embodiments, the loading and release surfaces (75 and 70, respectively) may angularly intersect to form a release edge 79, whereby the ends of the impeller blades abruptly disengage from the cams as a respective blade end passes over the release edge. Such abrupt disengagement may facilitate the respective blade to flick or snap forward to its straight, unbent position as noted above.

In the illustrated embodiment, four cams 40 form and define four suction ports 72 between adjacent pairs of the cams (see, e.g., FIG. 4A). One will appreciate, however, that the number of cams and corresponding suction ports may vary. In accordance with various aspects of the present invention, the pump may be provided with two to ten, or more cams with a corresponding number of suction ports to effectively create two to ten or more unit chambers, which configurations may provide increased flow rates and/or pressure capabilities. For example, providing three, four or more chambers may provide approximately 3:1, 4:1 or greater output as compared to conventional flexible impeller pumps having a single inlet and a single outlet. Such multi-chamber configurations may also reduce the angular travel of each unit chamber per revolution and thus may minimize "dead space" or unnecessary angular travel of fluid per revolution of the pump. Such a configuration may also provide an approximately 1:3, 1:4 or smaller size reduction in comparison to conventional flexible impeller pumps for use to mount where space is minimal.

Advantageously, the multiple unit chamber configuration in accordance with various aspects of the present invention may also allow for operation even when the pump is not full of fluid, that is, even when air has entered the interior pump chamber. In this situation, the unit or blade chambers below the water line are still capable of filling, sealing, and moving their respective fluid units toward their respective evacuation ports.

Figure 7:
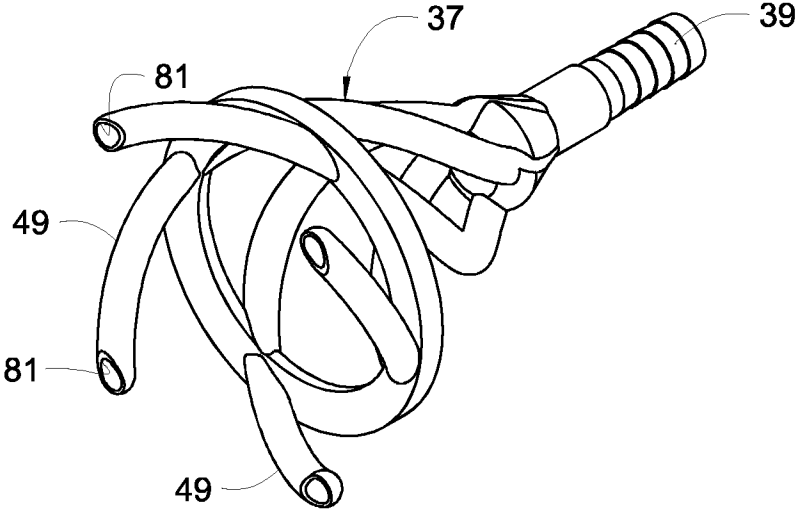
FIG. 7 is a perspective view of a manifold of the pump shown in FIG. 1.

With reference to FIG. 2 and FIG. 7, outlet manifold 37 extends from the cam wall 54 of housing 32, and the manifold includes a plurality of branches 49 fluidly connected with corresponding ones of the evacuation ports 47. In particular each branch includes a passageway or lumen 81 extending the length of the branch to outlet 39. Fluid moves through the lumina from the evacuation ports and may converge together at outlet 39, which outlet serves as a confluence that combines flow from all branches, increases fluid velocity, and may prevent backflow. One may appreciate, however, that in various embodiments, the branches may lead to different outlets. For example, each branch could lead to respective separate outlets, or two branches may lead to a first outlet and two other branches may lead to a second outlet. One will also appreciate that, instead of discrete branches (e.g., having discrete outside surfaces), the manifold may be formed with one or more lumina encased within in a solid body for increased structural integrity. One will further appreciate that the shape of a branch need not follow the shape of the lumen therein (e.g., a lumen of increasing or decreasing cross-sectional area may extend through a branch having a uniform outer diameter).

One will also appreciate that the lumina may vary in length, shape and/or cross-sectional size so that flow from each evacuation port to the outlet may be adjusted. For example, one or more lumina may be longer than other lumina in order to lengthen the amount of time a volume of fluid flows from an evacuation port as compared to another evacuation port. And/or one or more lumina may be larger in cross-sectional area than other lumina to shorten the amount of time a volume of fluid flows from an evacuation port as compared to another evacuation port. Such variations may be used to limit pump harmonics and/or otherwise adjust confluence pulsing as desired.

Figure 9:
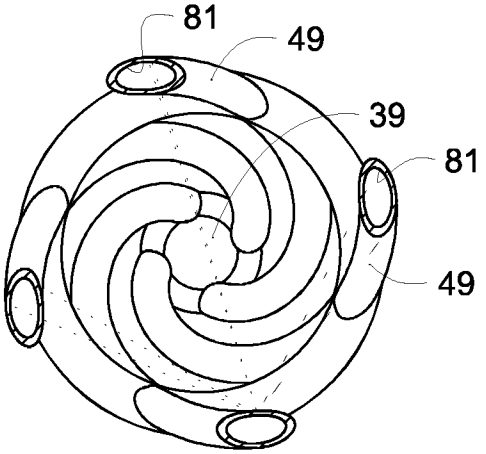
FIG. 9 is a cross-sectional view of the manifold taken along line 9-9 of FIG. 8.
Figure 10:
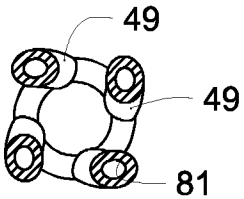
FIG. 10 is another cross-sectional view of the manifold taken along line 10-10 of FIG. 8.

In accordance with various aspects of the present invention, the lumina may have a decreasing cross-sectional area and passageway diameter as the lumina extend away from the evacuation ports. For example, each lumen 81 may have a first internal cross section proximal the respective evacuation port (see, e.g., FIG. 9) and a second internal cross section proximal the outlet port (see, e.g., FIG. 10) that is smaller than the first. As fluid exits the evacuation ports and flows through the lumina of the manifold, fluid velocity increases due to the decreasing passage diameters (and the collectively decreasing cross-sectional area of the lumina) from the evacuation ports to the outlet. The decreasing passage diameters (and cross-sectional areas) of the lumina may contribute to increasing fluid velocity through the lumina.

Figure 8:
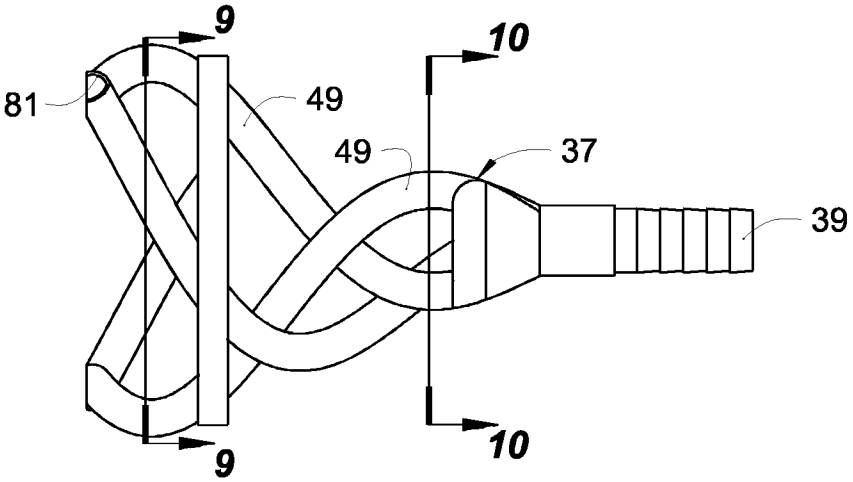
FIG. 8 is side view of the manifold shown in FIG. 7.

And in accordance with various aspects of the present invention, the branches (and lumina therein) may spiral away from their respective evacuation ports along a gradually tightening curve, as shown in FIG. 7 and FIG. 8. Branches 49 (and the lumina 81 therein) may spiral from a wide base diameter adjacent the evacuation ports (see, e.g., FIG. 9), through a narrower diameter adjacent the outlet port (see, e.g., FIG. 10), to a central point of outlet 39. While the height of the spiral, combined with the decreasing passageway size, accounts for additional velocity, so does the centrifugal spiral of the wide base diameter to the outlet, which may additionally increase the velocity of the fluid movement through the lumina, and which may additionally increase pressure capabilities of the pump. The spiral configuration of the manifold may also serve to preserve kinetic energy of the fluid flowing through the manifold. One will appreciate that in various embodiments, the branches might not spiral and may instead lead directly from their evacuation ports to their outlet(s) along a straight line.

In various embodiments, the manifold and the cam wall may be monolithically formed. Again, such monolithic configuration is particularly well suited for additive manufacturing processes such as 3D printing. One will appreciate that subtractive manufacturing may be used to machine or mill, molding and casting may be used to shape, and or other suitable processes may be also used to form these structures.

In operation and use, fluid enters pump housing 32 through inlet 33 and fills peripheral reservoir 42 (see arrows F in FIG. 3). Preferably the volume of the peripheral reservoir and the cross-sectional area of suction ports 72 is significant in comparison to the unit chambers 74 associated with each cam 40 to ensure that a large volume of fluid is available for impeller 46 to move within the unit chambers (see, e.g., unit chambers 74 in FIG. 4A to FIG. 4C). Such configuration may reduce friction loss while improving fluid dynamics such as suction and still achieving positive displacement of fluid without having dedicated housing inlets for each suction port. One will appreciate, however, that various aspects of the present invention may be used in conjunction with dedicated inlet ports instead of a peripheral reservoir.

As impeller 46 turns, a respective blade 60 moves from engagement edge 63 along arcuate cam surface 67 toward the lobe 68 where a flexible blade makes contact with loading surface 75 and squeezes or sweeps fluid along the loading surface toward, into, and through a respective evacuation port 47.

As fluid flows through the evacuation ports, into and through the manifold, fluid velocity may increase through the manifold. In various embodiments, the cross-sectional areas of the lumina 81 adjacent the evacuation ports 47 (see, e.g., FIG. 9) is larger than the cross-sectional areas of the lumina 81 proximal outlet 39 (see e.g., FIG. 10) whereby the Venturi effect of a decreasing cross-sectional area increases fluid velocity through the manifold toward outlet 39 thus making backflow difficult and increasing pressure capabilities.

Figure 11B:
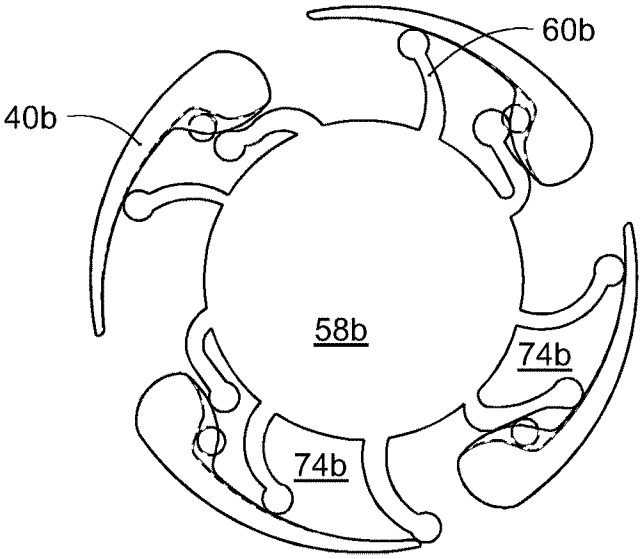
FIG. 11A, FIG. 11B and FIG. 11C are schematic views of alternate cam and impeller configurations in accordance with various aspects of the present invention.
Figure 11C:
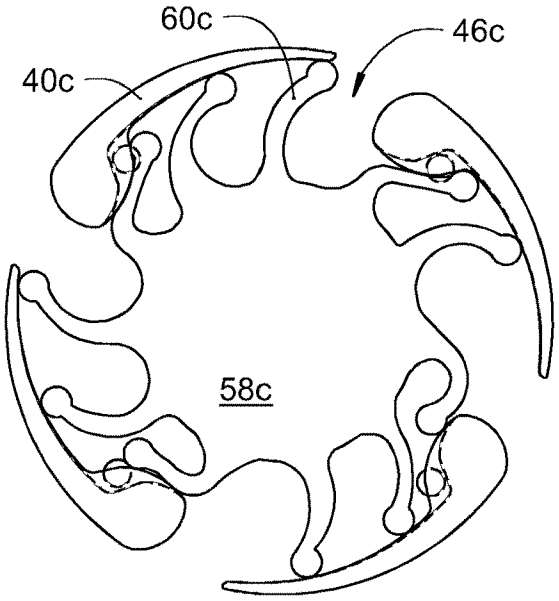
Figure 11A:
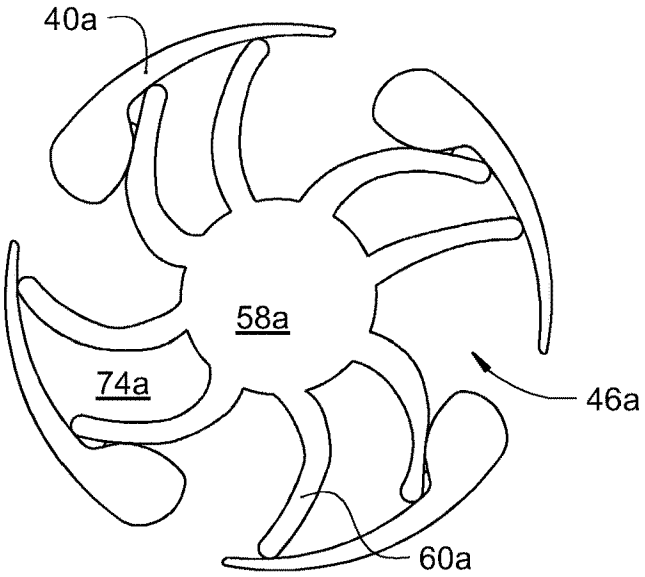

Turning now to FIG. 11A, one will appreciate the configuration of the cams and impellers may vary in accordance with various aspects of the present invention. For example, the impeller hub 58*a* may have a smaller diameter as shown in FIG. 11A to provide larger blade/unit chambers 74*a*. As also shown in FIG. 11A, the cams 40*a* may be configured for counter-clockwise rotation of impeller 46*a*. The number of impeller blades 60*a* may vary in various applications. In this illustrated embodiment, eight blades are provided as opposed to the nine blades shown in the embodiments described above, but one will appreciate that the two, three, four or more blades may be used in certain applications. And the impeller blades may have a generally uniform thickness wherein the ends may be no thicker, or even thinner, than the body of the blade. One will also appreciate that various features and aspects of the present invention may be used with other types of impellers such as a sliding vane impeller.

As shown in FIG. 11B, impeller hub 58*b* may have a larger diameter to provide shorter blades 60*b* and smaller blade/unit chambers 74*b*, which configuration may be suitable for higher pressure and/or higher viscosity applications.

And as shown in FIG. 11C, impeller 46*c* may have a greater blade-to-cam ratio (for example eleven blades 60*c* may be provided for four cams 40*c*), which configuration may create two, adjacent blade chambers for each cam thereby increasing fluid flow and or pressure capabilities.

Figure 12:
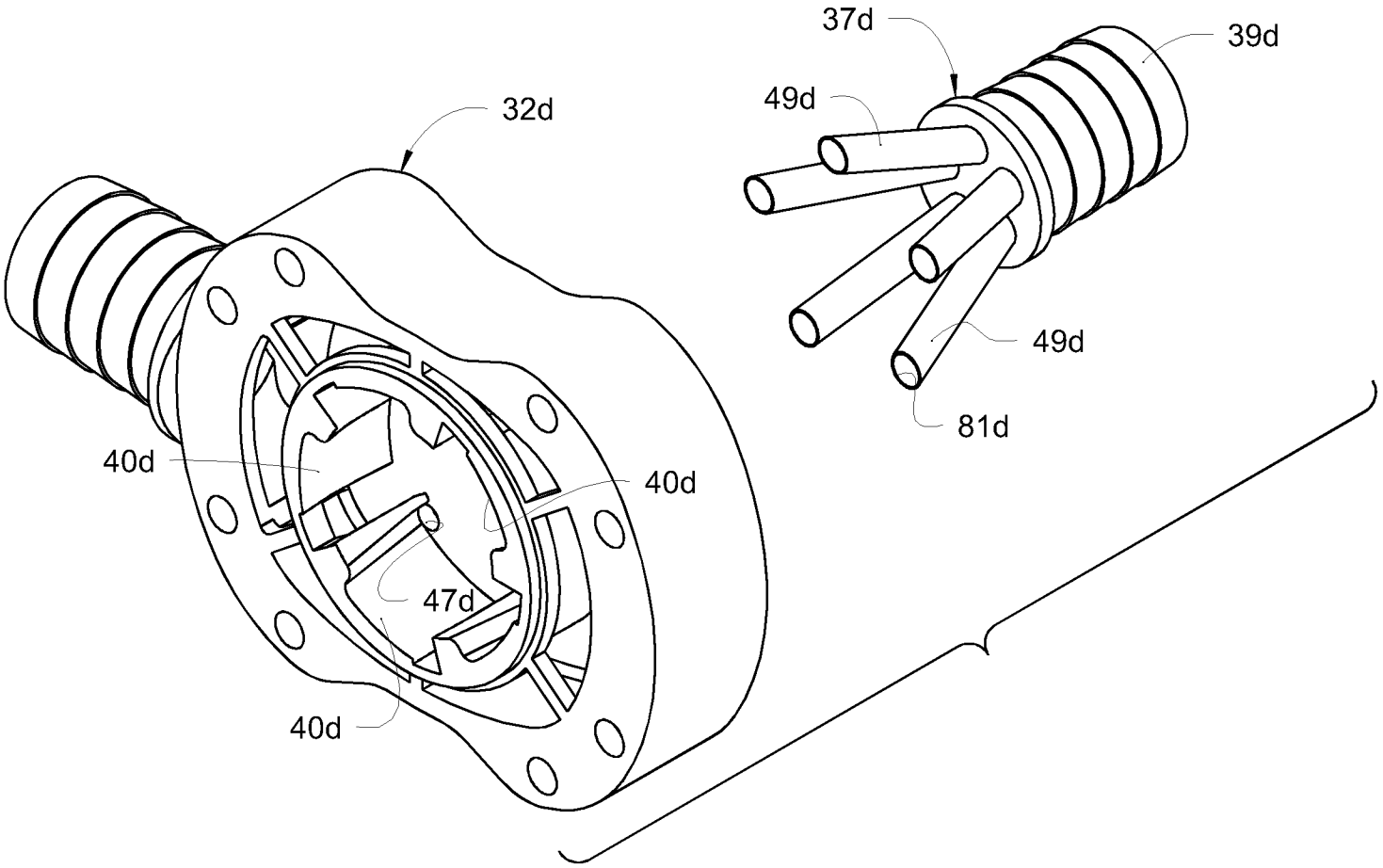
FIG. 12 is a perspective view of alternate cam and manifold configurations in accordance with various aspects of the present invention.

Turning now to FIG. 12, alternative housing and manifold configurations are illustrated having features that may be used, together or separately, in various embodiments. For example, and as noted above, the pump may be provided with two to ten, or more cams. And as also noted above, the manifold may include various passageway configurations including curving or straight lumina. In this illustrated embodiment, housing 32*d* includes five circumferentially spaced cams 40*d* and five corresponding evacuation ports 47*d* which are fluidly connected to five respective lumina 81*d*.

The five cams may be used in conjunction with an impeller having six or more blades (or four or less blades) in an effort to reduce pulsing fluid flow in the outlet—a mismatched number of cams and blades will effectively vary the timing at which the respective blades pass their respective evacuation ports (see, e.g., FIG. 11B and FIG. 11C) and may thus reduce pulsing. In contrast, a matched number of cams and impeller blades (or multiple thereof) will cause the respective blades to pass their respective evacuation ports at substantially the same time (see, e.g., FIG. 11A), in which case fluid may evacuate through each of the evacuation ports at substantially the same time.

With continued reference to FIG. 12, the straight-lumina configuration of manifold 37*d* allows for a shorter and more direct path from evacuation ports 47*d* to outlet 39*d*. Such configuration may lessen frictional losses through the lumina and may preserve fluid velocity and/or fluid pressure from the evacuation ports to the outlet in certain applications.

Figure 13:
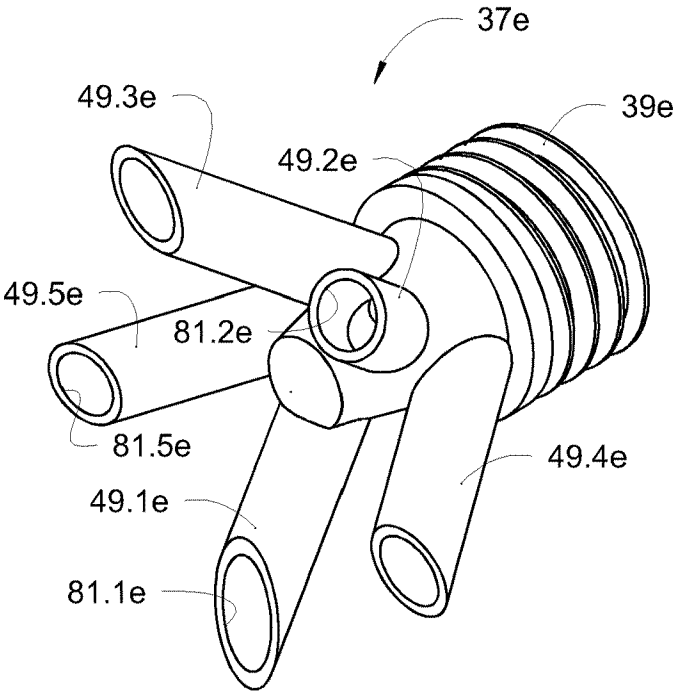
FIG. 13 is a perspective view of another alternate manifold configuration similar to that shown in FIG. 12 in accordance with various aspects of the present invention.
Figure 18:
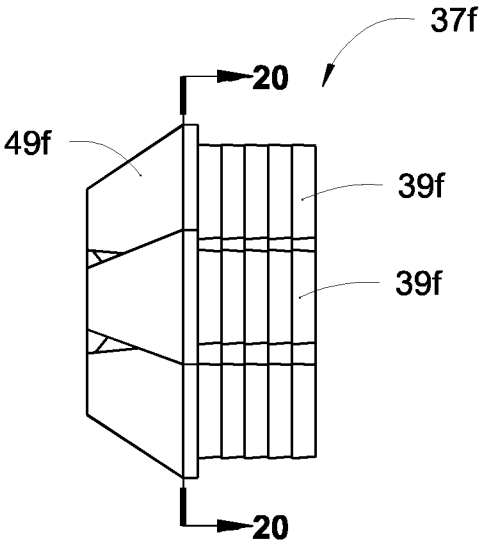
FIG. 18 is a side view of the manifold configuration of FIG. 17.

Turning now to FIG. 13, an alternative manifold configuration is illustrated having other features that may be used in various embodiments. As noted above, when a matched number of cams and impeller blades (or a multiple thereof) is used, respective blades pass their respective evacuation ports at substantially the same time (see, e.g., FIG. 11A). Such a configuration may contribute to fluid pulsing at the outlet especially when all lumina have the same lengths and cross-sectional profiles. In order to reduce, minimize and/or prevent such pulsing, the lumina geometries may be varied in order to tune or adjust the fluid flow from each respective evacuation port the outlet.

Figure 15:
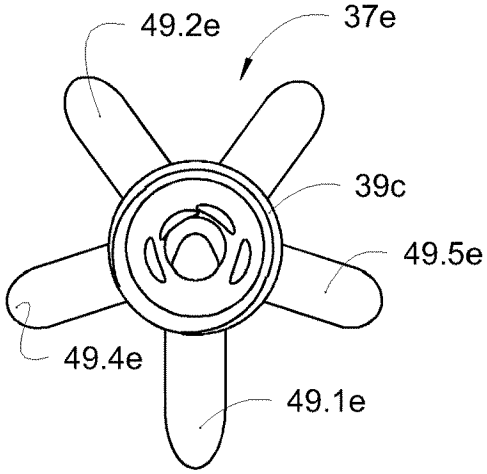
FIG. 15 is an outlet-end view of the manifold configuration of FIG. 13.
Figure 14:
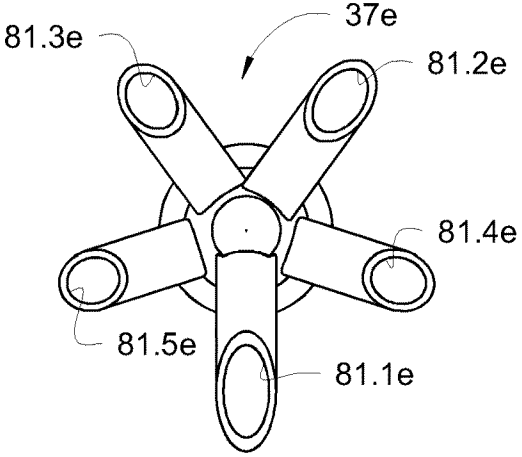
FIG. 14 is an inlet-end view of the manifold configuration of FIG. 13.
Figure 16:
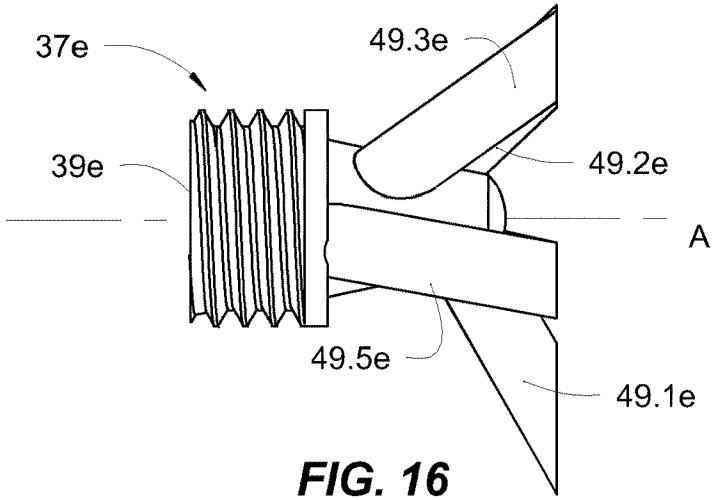
FIG. 16 is a side view of the manifold configuration of FIG. 13.

For example, manifold 37*e* includes lumina of varying length that fluidly connect with outlet 39*e* at different points along its longitudinal axis A (see FIG. 16). For example first branch 49.1*e* and lumen 81.1*e* extend from their evacuation port and fluidly connect with outlet 39*e* at a first closest position to the evacuation ports, while a second branch 49.2*e* and lumen 81.2*e* extend from their evacuation port and fluidly connect with outlet 39*e* at a second further position, and so on with last branch 49.5*e* and lumen 81.5*e* extending from their evacuation port and fluidly connecting with outlet 39*e* at a furthest position, as shown in FIG. 14, FIG. 15 and FIG. 16. Such differences in lumina geometries cause fluid exiting from the evacuation ports at the same time to converge within outlet 39*e* at slightly different locations and/or times (see, e.g., FIG. 15) which may reduce, minimize and/or prevent fluid pulsing within the outlet.

The manifold shown in FIG. 13 includes a threaded outlet, while the other illustrated manifolds have barbed outlets. One will appreciate that in various embodiments, the outlets may have barbed, threaded, and/or other suitable outlet configurations for fluidly connecting manifolds in an otherwise conventional manner in various applications.

Figure 17:
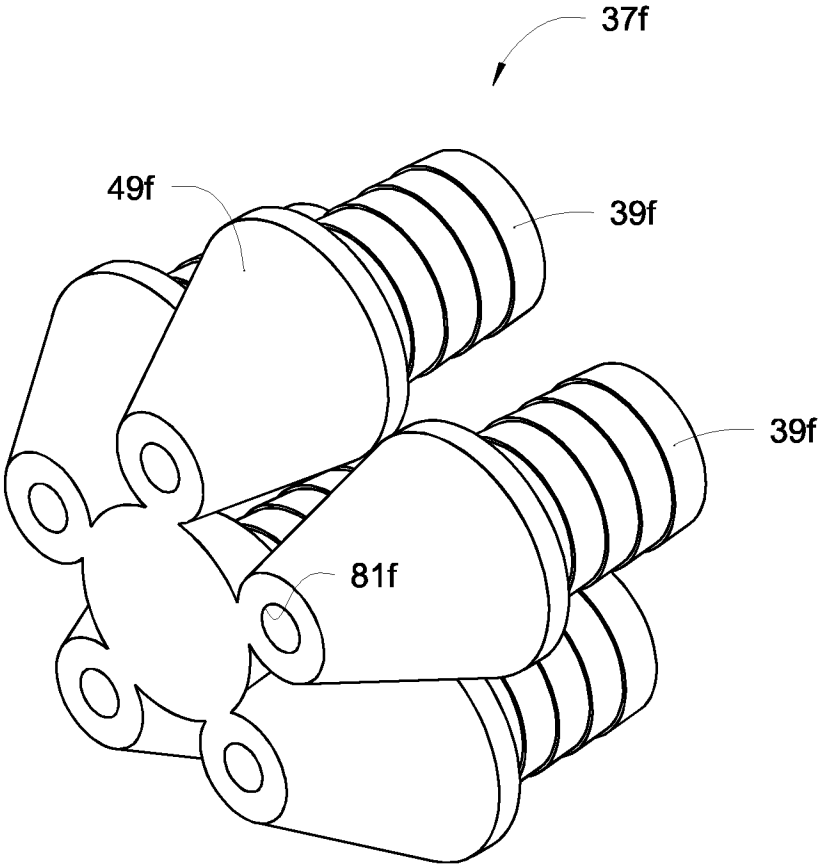
FIG. 17 is a perspective view of another alternate manifold configuration similar to that shown in FIG. 12 and FIG. 13 in accordance with various aspects of the present invention.

Turning now to FIG. 17, an alternative manifold configuration is illustrated having further features that may be used in various embodiments. In contrast to the above embodiments, manifold 37*f* includes a plurality of outlets 39*f* in which each evacuation port has a dedicated outlet. One will appreciate the multiple-outlet configuration may be used in various applications, and that any of the above embodiments may be provided with such dedicated outlets. One will further appreciate that a manifold may have one or more branches/lumina that converge in one outlet, with one or more other branches/lumina having their own outlet. And one will appreciate that the branches/lumina may be curved, straight, staggered and/or a combination thereof.

Figure 20:
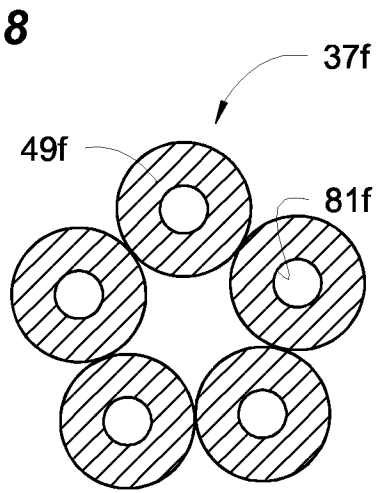
FIG. 20 is a cross-sectional view of the manifold configuration taken along line 20-20 of FIG. 18.
Figure 19:
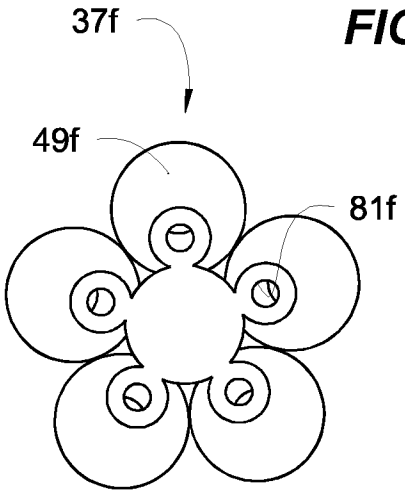
FIG. 19 is an inlet-end view of the manifold configuration of FIG. 17.

As noted above, the cross-sectional areas of the lumina may decrease, which may increase fluid velocity and/or pressure of fluid flowing through the lumina. Similarly, the cross-sectional areas of the lumina may increase, which may decrease fluid velocity and/or fluid pressure in certain applications. For example, manifold 37*f* includes lumina 81*f* having relatively small cross-sectional areas adjacent the evacuation ports (see, e.g., FIG. 19) and a relatively large cross-section adjacent their outlet ports (see, e.g., FIG. 20). One will appreciate that such increasing cross-section configuration may be used with manifolds having multiple lumina converging into the same outlet, in which case, the outlet may be sized accordingly.

In accordance with various aspects of the present invention, pumps described above are particularly well suited for use with non-compressible fluids such as water, etc., because the arcuate cam surface and the loading surface maintain impeller blades in a desirable flexed shape while preventing fluid back flow after entering the suction port.

For convenience in explanation and accurate definition in the appended claims, the terms "below," "clockwise," "interior," etc. are used to describe features of the exemplary embodiments with reference to the positions of such features as displayed in the figures.

In many respects, various modified features of the various figures resemble those of preceding features and the same reference numerals followed by subscripts "a", "b", "c", "d", "e" and "f" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A pump comprising:

an impeller including a hub and a plurality of blades extending radially from the hub, each blade having an end;

a plurality of circumferentially spaced cams defining an impeller chamber within which the impeller is rotatably mounted; wherein each cam includes an engagement edge, an arcuate cam surface sloping radially inward from the engagement edge, and a lobe that extends radially inward from the arcuate cam surface; and a plurality of circumferentially spaced evacuation ports, each evacuation port being proximal to the intersection of the arcuate cam surface and the lobe of a respective cam;

wherein, as the impeller rotates, a corresponding end of a leading blade of the plurality of blades contacts a respective engagement edge and then a corresponding end of a trailing blade of the plurality of blades subsequently contacts the respective engagement edge thereby forming a unit chamber between: the leading and trailing blades; the impeller hub; and the respective cam of the plurality of circumferentially spaced cams; and wherein, as the impeller continues to rotate, the end of the leading blade contacts a respective lobe and displaces the leading blade to decrease the volume of the unit chamber and expel fluid from the unit chamber through a respective evacuation port.

2. A pump according to claim 1, further comprising:

a housing including a peripheral wall, wherein the plurality of circumferentially spaced cams are located radially inward from the peripheral wall;

a peripheral reservoir defined between the peripheral wall and the plurality of circumferentially spaced cams; and a plurality of suction ports fluidly communicating the peripheral reservoir with the impeller chamber, each suction port being defined by a respective lobe of a first cam of the plurality of circumferentially spaced cams and a respective engagement edge of an adjacent second cam of the plurality of circumferentially spaced cams;

wherein, as the impeller rotates, the impeller draws fluid from the peripheral reservoir through the plurality of suction ports and delivers fluid to the plurality of circumferentially spaced evacuation ports.

3. A pump according to claim 1, wherein the plurality of circumferentially spaced cams includes four circumferentially spaced cams.

4. A pump according to claim 1, wherein the pump includes a housing with a planar wall from which the plurality of circumferentially spaced cams are cantilevered and through which the plurality of circumferentially spaced evacuation ports extend, wherein each lobe is proximate to a respective evacuation port and extends away from the planar wall to a free end, wherein the free end extends above the respective evacuation port.

5. A pump according to claim 4, wherein a portion of each free end is perpendicularly above the respective evacuation port.

6. A pump according to claim 5, wherein the portion of each free end perpendicularly covers the respective evacuation port.

7. A pump according to claim 1, wherein each lobe includes a loading surface extending radially inward from the arcuate cam surface and a release surface extending radially outward from the loading surface; wherein, as the impeller rotates, the respective blade ends of the plurality of blades disengage from the plurality of circumferentially spaced cams as a respective blade end passes from the loading surface to the release surface.

8. A pump according to claim 7, wherein the loading surface smoothly transitions from the arcuate cam surface allowing the blade ends to sweep along the arcuate cam surface and the loading surface past the respective evacuation port.

9. A pump according to claim 7, wherein respective loading and release surfaces angularly intersect to form a release edge, whereby the blade ends of the impeller abruptly disengage from the plurality of circumferentially spaced cams as a respective blade end passes over the release edge.

10. A pump according to claim 1, further comprising a housing, the housing including a peripheral wall and a cam wall, the cam wall having an inner planar surface against which the impeller rotates, wherein the plurality of circumferentially spaced cams extend from the cam wall.

11. A pump according to claim 10, further comprising an outlet manifold extending from the cam wall, wherein the outlet manifold includes a plurality of lumina, each corresponding to a respective evacuation port.

12. A pump according to claim 11, wherein the outlet manifold includes an outlet port, wherein each lumen of the plurality of lumina has a first internal cross section proximal the respective evacuation port and a second internal cross section proximal the outlet port, and wherein the second cross section is smaller than the first.

13. A pump according to claim 11, wherein each lumen of the plurality of lumina has a first internal cross section proximal the respective evacuation port and a second internal cross section proximal an outlet port, and wherein the second cross section is larger than the first.

14. A pump according to claim 11, wherein each lumen of the plurality of lumina spirals from a respective evacuation port along a gradually tightening curve.

15. A pump according to claim 14, wherein the outlet manifold includes an outlet port, wherein each lumen has a first internal cross section proximal the respective evacuation port and a second internal cross section proximal the outlet port, and wherein the second cross section is smaller than the first.

16. A pump according to claim 11, wherein each lumen of the plurality of lumina linearly extends from a respective evacuation port to an outlet port.

17. A pump according to claim 11, wherein each lumen of the plurality of lumina extends from a respective evacuation port to a common outlet port.

18. A pump according to claim 11, wherein each lumen of the plurality of lumina extends from a respective evacuation port to a corresponding outlet port.

19. A pump according to claim 11, wherein the outlet manifold includes an outlet port having an axis, wherein each lumen of the plurality of lumina is fluidly connected to the outlet port at a respective junction, and wherein one or more of the respective junctions are axially spaced within the outlet port from one another.

20. A pump comprising:

an impeller including a hub and a plurality of blades extending radially from the hub, each blade having an end;

a housing including a peripheral wall, a plurality of circumferentially spaced cams located radially inward from the peripheral wall, and a peripheral reservoir defined between the peripheral wall and the plurality of circumferentially spaced cams, wherein the plurality of circumferentially spaced cams define an impeller chamber within which the impeller is rotatably mounted, and wherein each cam includes an engagement edge and a release surface;

a plurality of suction ports fluidly communicating the peripheral reservoir with the impeller chamber, each suction port being defined by a respective release surface of a first cam of the plurality of circumferentially spaced cams and a respective engagement edge of an adjacent second cam of the plurality of circumferentially spaced cams; and a plurality of circumferentially spaced evacuation ports, each evacuation port being intermediate the engagement edge and the release surface of a respective cam;

wherein, as the impeller rotates, the impeller draws fluid from the peripheral reservoir through the plurality of suction ports and delivers fluid to the plurality of circumferentially spaced evacuation ports.

21. A pump according to claim 20, wherein the release surface has a respective lobe that extends radially inward from each respective arcuate cam surface of the respective engagement edge, and wherein each evacuation port is proximal the intersection of the arcuate cam surface and the lobe of a respective cam;

wherein, as the impeller rotates, a corresponding end of a leading blade of the plurality of blades contacts a respective engagement edge and a corresponding end of a trailing blade of the plurality of blades subsequently contacts the respective engagement edge thereby forming a unit chamber between: the leading and trailing blades; the impeller hub; and the respective cam of the plurality of circumferentially spaced cams; and wherein, as the impeller continues to rotate, the corresponding end of the leading blade contacts a respective lobe and displaces the leading blade to decrease the volume of the unit chamber and expel fluid from the unit chamber through a respective evacuation port.

* * * * *